US011717718B2

(12) United States Patent
Noorzai et al.

(10) Patent No.: US 11,717,718 B2
(45) Date of Patent: Aug. 8, 2023

(54) COMBINATION THERAPEUTIC AND EXERCISE SINGLE BOARD ELLIPTICAL-MOTION DEVICE

(71) Applicants: Sophia Noorzai, Moorpark, CA (US); Ava Noorzai, Moorpark, CA (US); Olivia Noorzai, Moorpark, CA (US); Hana Noorzai, Moorpark, CA (US); Jennifer Noorzai, Moorpark, CA (US); Malik Noorzai, Moorpark, CA (US)

(72) Inventors: Sophia Noorzai, Moorpark, CA (US); Ava Noorzai, Moorpark, CA (US); Olivia Noorzai, Moorpark, CA (US); Hana Noorzai, Moorpark, CA (US); Jennifer Noorzai, Moorpark, CA (US); Malik Noorzai, Moorpark, CA (US)

( * ) Notice: Subject to any disclaimer, the term of this patent is extended or adjusted under 35 U.S.C. 154(b) by 96 days.

(21) Appl. No.: 17/316,550

(22) Filed: May 10, 2021

(65) Prior Publication Data

US 2021/0346753 A1 Nov. 11, 2021

Related U.S. Application Data

(60) Provisional application No. 63/022,616, filed on May 11, 2020.

(51) Int. Cl.
*A63B 22/00* (2006.01)
*A63B 22/06* (2006.01)
(Continued)

(52) U.S. Cl.
CPC .... *A63B 22/0025* (2015.10); *A63B 21/00069* (2013.01); *A63B 21/015* (2013.01); *A63B 22/0664* (2013.01); *A63B 22/14* (2013.01); *A63B 2022/0033* (2013.01); *A63B 2022/067* (2013.01)

(58) Field of Classification Search
CPC ..... A63B 21/00069; A63B 21/015; A63B 21/22–227; A63B 21/4049; A63B 22/0025; A63B 22/0664; A63B 22/14; A63B 22/18; A63B 2022/0033; A63B 2022/067–0676; A63B 2022/0688;
(Continued)

(56) References Cited

U.S. PATENT DOCUMENTS 5,904,636 A * 5/1999 Chen ..... A63B 69/0093 482/57
D415,224 S 10/1999 Broudy
(Continued)

*Primary Examiner* — Joshua Lee
*Assistant Examiner* — Kathleen M Fisk
(74) *Attorney, Agent, or Firm* — Stetina Brunda Garred & Brucker

(57) ABSTRACT

An exercise device including a base having a channel formed therein, and a wheel rotatably connected to the base. The exercise device additionally includes a support link having a first end portion slidably connected to the channel and a second end portion pivotally connected to the wheel. The exercise device further comprises a single platform having an upper surface sized to support both feet of a user. The single platform is connected to the support link such that the single platform moves in concert with the support link. A first rotation member is coupled to the single platform and configured to rotate relative to the single platform about a first rotation axis generally perpendicular to the upper surface.

19 Claims, 4 Drawing Sheets

(51) Int. Cl.
*A63B 22/14* (2006.01)
*A63B 21/015* (2006.01)
*A63B 21/00* (2006.01)

(58) Field of Classification Search
CPC .... A63B 2022/0038; A63B 26/00–003; A63B 23/0423; A63B 69/0093
See application file for complete search history.

(56) References Cited

U.S. PATENT DOCUMENTS

D422,325 S 4/2000 Broudy
D431,616 S 10/2000 Broudy
D481,086 S 10/2003 Broudy
6,752,744 B2 * 6/2004 Arnold ..... A63B 22/0664 482/52
6,790,166 B2 9/2004 Broudy
6,860,837 B2 * 3/2005 Chang ..... A63B 69/0093 482/51
8,636,627 B2 * 1/2014 Zhang ..... A61B 5/1126 482/52
8,795,139 B2 * 8/2014 Zhang ..... A63B 71/0054 482/52
9,242,138 B2 * 1/2016 Mukenev ..... A63B 22/001
10,207,150 B2 2/2019 Noorzai et al.
11,020,626 B2 * 6/2021 Yu ..... A63B 22/0664
11,247,097 B2 * 2/2022 Chen ..... A63B 21/4035
2003/0060337 A1 * 3/2003 Yu ..... A63B 69/0093 482/57
2007/0298945 A1 * 12/2007 Mehta ..... A63B 22/14 482/130
2008/0167165 A1 * 7/2008 Liao ..... A63B 22/001 482/52
2008/0312044 A1 * 12/2008 Chen ..... A63B 22/0064 482/52
2011/0287914 A1 * 11/2011 Morris ..... A63B 23/0205 482/147
2013/0165303 A1 * 6/2013 Niastro ..... A63B 69/0057 482/147
2017/0239515 A1 * 8/2017 Leong ..... A63B 22/14

* cited by examiner

COMBINATION THERAPEUTIC AND EXERCISE SINGLE BOARD ELLIPTICAL-MOTION DEVICE

CROSS-REFERENCE TO RELATED APPLICATIONS

The application claims the benefit of U.S. Provisional Application Ser. No. 63/022,616, filed May 11, 2020, the contents of which are expressly incorporated herein by reference.

STATEMENT RE: FEDERALLY SPONSORED RESEARCH/DEVELOPMENT

Not Applicable

BACKGROUND

1. Technical Field

The present disclosure relates generally to cardiovascular exercise machines, and more specifically, to an elliptical-style exercise machine having a single support platform configured to support a user in a side-stance position relative to motion of the support platform.

2. Description of the Related Art

The benefits of regular aerobic and anaerobic exercises are well established. For instance, regular aerobic and anaerobic exercise may dramatically improve cardiac stamina and function, as well as lead to weight loss, increased metabolism, balance, strength and other therapeutic benefits. It is generally desirable to exercise several different muscles connected to the core of the body. To maximize muscle connectivity, strength, flexibility and to achieve optimum levels of aerobic and anaerobic exercises, a user may engage their core over a significantly large range of motion so as to provide for balanced physical development. It is further advantageous for exercise equipment to provide smooth and natural motion, thus avoiding significant jarring and straining that can damage both muscles and joints.

Injury avoidance and mitigation may be a primary objective when participating in low-impact aerobic exercises. While there may be a significant desire to participate in low-impact aerobic exercises, many low-impact aerobic exercises have traditionally been difficult to perform. Along these lines, many low-impact aerobic exercises (such as those performed in water) traditionally require performance either outside or at a gym with special facilities. Viruses such as the COVID-19, cold weather, other undesirable conditions, and cost can make aerobic exercise unobtainable at times. In order to allow people to perform these exercises without having to go outside or to gyms or the like, fitness machines have been developed to allow a user to perform aerobic exercises in a small area of their home.

One example of a conventional low-impact aerobic exercise machine is an elliptical-type exercise machine, which may comprise a pair of reciprocating foot platforms (steps) designed to receive and support each foot of the user. During use, the foot platforms may travel in opposite directions to each other to simulates a striding motion of the user for exercise purposes.

While various exercise systems, such as the traditional elliptical machines, are known in prior art, such systems may suffer from a variety of shortcomings that limit their benefits and/or include unnecessary risks and undesirable features. For example, traditional elliptical, treadmill, and stationary bike machines may use a stride movement wherein the user's feet move in opposite directions during exercise activity. While this may be an obvious and natural walking movement, it may not focus on the ability of the entire body to generate a unified balanced movement from the core of the body. These machines utilize only a relatively small number of muscles, through fairly limited range of motion. Consequently, the user's mind may not be engaged with the physical activity, due to the balance of the body being spread out holding the handlebars or locking in the feet in the separate steps. Another drawback of such machines may be significant jarring of the hip, knee, ankle and other joints of the body that may occur during use.

Furthermore, with specific regard to conventional elliptical machines the dimension of the path traversed by the user's feet may be severely limited in size, direction and shape by the design of the machine. The ellipses generated by these machines are often created by the interaction of a plurality of different partial motions, and attempts to alter the motion of a user in one dimension often alters the motion in another as well.

Accordingly, there is a need in the art for an exercise device that addresses the deficiencies noted above. Various aspects of the present disclosure address this particular need, as will be discussed in more detail below.

BRIEF SUMMARY

Various aspects of the present disclosure relate to an exercise device having a surfboard-like platform that is moveable in an elliptical motion (e.g., up-and-down, as well as front-and-back). The exercise device may be configured to provide large strides (e.g., front-and-back motion) that in certain embodiments, may range from 18-40 inches. Furthermore, the board may be moveable in up to five degrees of motion, namely, front-and-back motion, up-and-down motion, swiveling motion of the platform (e.g., swivel about an axis perpendicular to the upper surface of the platform), side-to-side lean of the platform (e.g., leaning of the platform to the left and right of an underlying support bar), and 360 lean of the platform (e.g., leaning of the platform in all directions relative to an underlying support bar).

In accordance with one embodiment of the present disclosure, there is provided an exercise device comprising a base having a channel formed therein, and a wheel rotatably connected to the base. The exercise device additionally includes a support link having a first end portion slidably connected to the channel and a second end portion pivotally connected to the wheel. The exercise device further comprises a single platform having an upper surface sized to support both feet of a user. The single platform is connected to the support link such that the single platform moves in concert with the support link. A first rotation member is coupled to the single platform and configured to rotate relative to the single platform about a first rotation axis generally perpendicular to the upper surface.

The exercise device may additionally include a resistance adjustment member operatively coupled to the first rotation member to facilitate selective adjustment of a rotational resistance of the first rotation member relative to the support platform.

The first rotation member may be sized to support both of the user's face at the same time.

The exercise device may further comprise a second rotation member coupled to the single platform and configured to rotate relative to the single platform about a second rotation axis generally perpendicular to the upper surface of the single platform and spaced from the first rotation axis. A third rotation member may also be coupled to the single platform and configured to rotate relative to the single platform about a third rotation axis generally perpendicular to the upper surface of the single platform and spaced from the first rotation axis. The exercise device may be configured such that, the first, second, and third rotation members are included in the exercise device, with the first rotation member residing between the single platform and the second and third rotation members.

The exercise device may also include a handle coupled to the base. The handle may be movable relative to the base. The exercise device may comprise a lower pivot link pivotally coupled to the base and an upper pivot link coupled to the handle and pivotally coupled to the lower pivot link.

According to another aspect of the present disclosure, there is provided a low impact, reciprocating exercise device comprising a base configured to be positionable on an underlying surface. The base extends along a longitudinal axis between a forward end portion and a rearward end portion. A support platform is operatively coupled to the base and is moveable relative to the base along an elliptical path in a direction generally parallel to the longitudinal axis. The support platform is sized and configured to simultaneously support both feet of the user. A first rotational platform is coupled to the support platform and configured to rotate relative to the support platform about a first rotational axis perpendicular to the support platform.

The exercise device may allow for active exercise and therapy to promote physical motion, balance, coordination, and a variety of therapeutic modalities for a user's body and core. The device may include a single support platform as a stand-alone solution, or alternatively, the support platform may be interconnected with single or double rotating discs mounted thereon. The bare platform, with or without the single or double rotating discs, may be adapted to receive the feet of an individual to stand thereon. In embodiments including one or more rotating discs, both feet may be placed on a single rotating disc, or each foot on a double rotating disc may rotate independently about a separate axis. In further embodiments, the rotating platforms may be provided with a variety of functional modalities, such as calorie, counting, distance travelled, and the like, or a therapeutic modality, such as heat, cold or pressure sensation to impart a therapeutic effect to the users feet.

The present disclosure will be best understood by reference to the following detailed description when read in conjunction with the accompanying drawings.

BRIEF DESCRIPTION OF THE DRAWINGS

These and other features and advantages of the various embodiments disclosed herein will be better understood with respect to the following description and drawings, in which.

Common reference numerals are used throughout the drawings and the detailed description to indicate the same elements.

DETAILED DESCRIPTION

Figure 1:
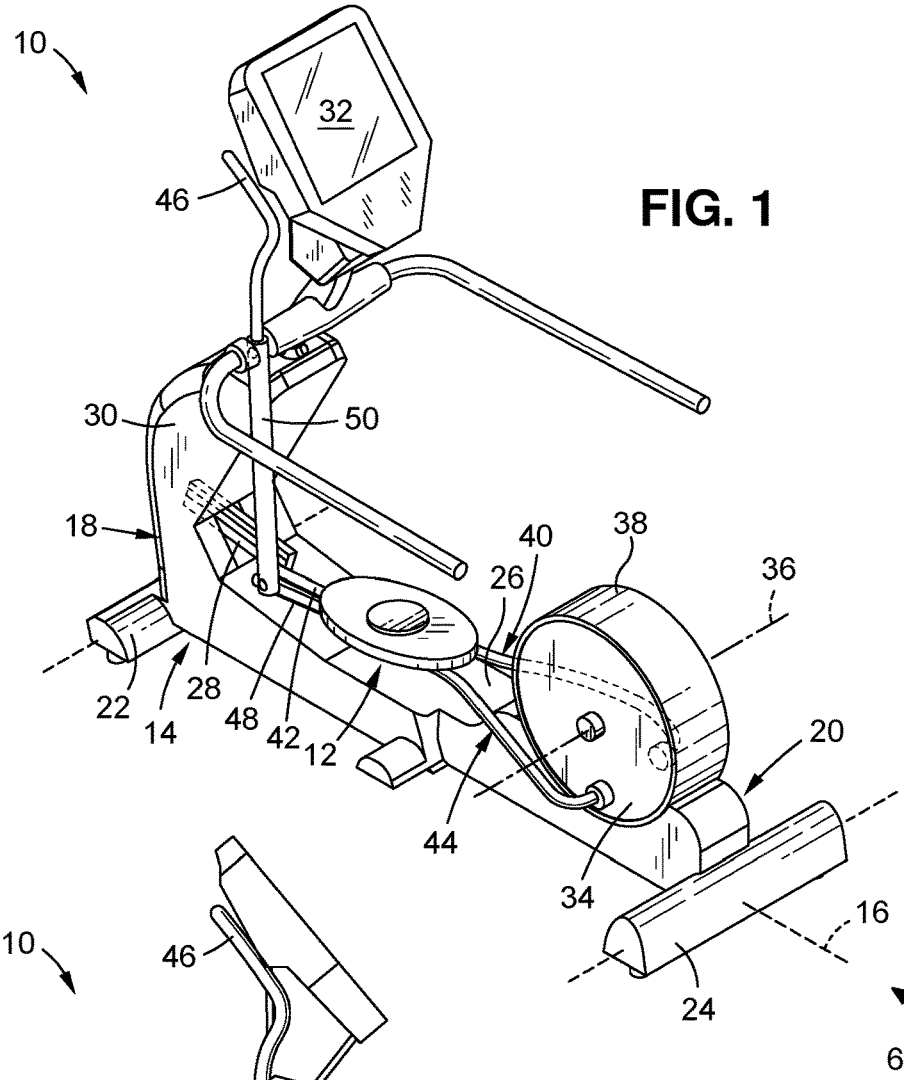
FIG. 1 is a rear, upper perspective view of a single-board elliptical motion exercise device in accordance with one embodiment of the present disclosure.

The detailed description set forth below in connection with the appended drawings is intended as a description of certain embodiments of an exercise device with a single platform and is not intended to represent the only forms that may be developed or utilized. The description sets forth the various structure and/or functions in connection with the illustrated embodiments, but it is to be understood, however, that the same or equivalent structure and/or functions may be accomplished by different embodiments that are also intended to be encompassed within the scope of the present disclosure. It is further understood that the use of relational terms such as first and second, and the like are used solely to distinguish one entity from another without necessarily requiring or implying any actual such relationship or order between such entities.

Referring now to the drawings wherein the showings are for purposes of illustrating preferred embodiments of the present disclosure, and are not for purposes of limiting the same, there is depicted a low-impact, reciprocating exercise device 10 including a single board/platform 12 that is sized to allow a user to stand thereon during use of the exercise device 10. The exercise device 10 differs from conventional elliptical machines based on the user being supported by a single platform 12, rather than a pair of smaller support bodies commonly found on conventional elliptical machines. The exercise device 10 is configured such that the single platform 12 is moveable in a balanced and smooth oval (ellipse) motion. The user may stands with both feet on the single platform 12 and may use portions of the entire body to press down on the platform 12 and build a continuous smooth oval (ellipse) motion going forward and/or backward, similar to riding a surfboard or skateboard. As such, when the user applies a force on the platform 12 to move the platform 12 through its range of motion, the user may engage portions of the upper body, lower body, and core in one fluid motion to provide a whole-body workout. Furthermore, one or more rotational platforms may be coupled to the single support platform 12 to provide a rotational component that may mitigate stress on a user's joints, while also facilitating a workout on stabilizing muscles on the user.

The exercise device 10 may include a base 14 configured to be positionable on an underlying surface (e.g., the ground). The base 14 extends along a longitudinal axis 16 between a forward end portion 18 and a rearward end portion 20. The base 14 may include a forward foot 22 at the forward end portion 18, a rearward foot 24 at the rearward end portion 20, and an elongate intermediate body 26 extending between the forward and rearward feet 22, 24. The forward and rearward feet 22, 24 may extend along respective axes that are generally perpendicular to the longitudinal axis 16 to provide stabilization to the exercise device 10 during use (e.g., to prevent undesirable rocking or swaying of the exercise device 10). The forward and rearward feet 22, 24 may be configured to reside along a common support plane when supported on the underlying support surface.

The elongate intermediate body 26 may provide a structural link between the forward and rearward feet 22, 24, and include a channel 28 formed therein adjacent the forward end portion. The channel 28 may be angled slightly upward, in a rear-to-front direction, relative to a plane parallel to the underlying support surface, and may be used to guide movement of the support platform 12, as will be described in more detail below.

The base 14 may optionally include an upwardly extending pedestal 30 at the forward end portion 18, with the pedestal 30 being configured to support a display screen 32 or a stand upon which a user may place an electronic display device (e.g., tablet computer), a towel, etc.

The exercise device 10 may additionally include a wheel 34 rotatably connected to the base 14. As shown in FIGS. 1-4, the wheel 34 is positioned adjacent the rearward end portion 20 of the base 14 and is operatively coupled to the support platform 12 to facilitate motion of the platform 12 along the elliptical path, as will be described in more detail below. The wheel 34 may be rotatable about a rotation axis 36 that is fixed relative to the base 14, i.e., the rotation axis 36 may not move relative to the base 14. Along these lines, the wheel 34 may include an axle that is fixed to the base 14. The base 14 may include a cover 38 extending over the outer diameter of the wheel 34 as a safety precaution to conceal the wheel 34 as the wheel 34 rotates.

Figure 5:
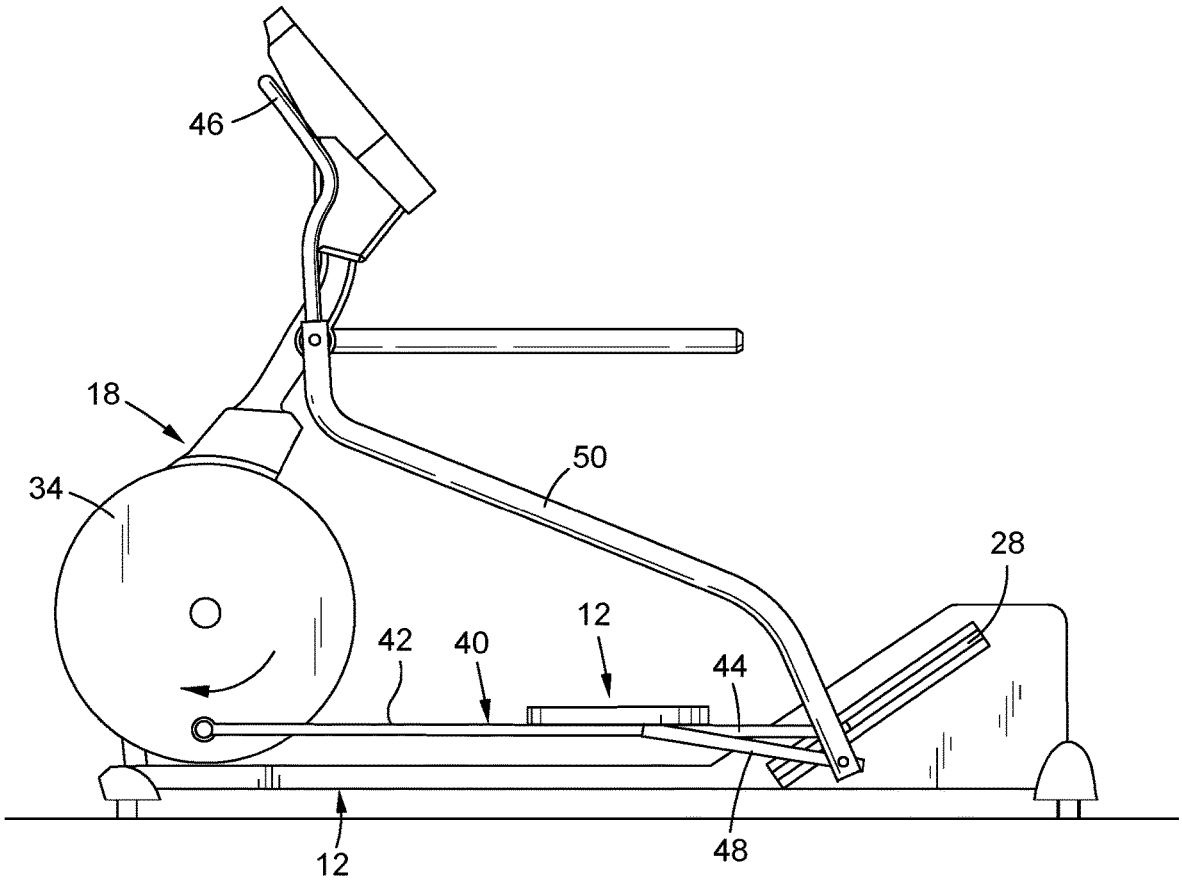
FIG. 5 is another embodiment of an exercise device with a front wheel and a rear guide ramp.

The arrangement of the wheel 34 and the channel 28 may be reversed from the configuration shown in FIGS. 1-4. In particular, FIG. 5 shows an embodiment wherein the wheel 34 is positioned in front of the support platform 12 and the channel 28 is positioned behind the support platform 12. The wheel 34 positioned in front of the support platform 12 may allow for larger strides (e.g., front-and-back motion) of the support platform 12.

One or more support links 40 may be connected to the wheel 34, the base 14, and the support platform 12 to facilitate the structural interconnection therebetween. As shown in According to one embodiment, the support link 40 includes a first end portion 42 slidably connected to the channel 28 and a second end portion 44 pivotally connected to the wheel 34. In the embodiment shown in FIG. 1, a pair of second end portions 44 extend from the support platform 12 to respective opposing sides of the wheel 34 to provide stability and balance. The first end portion 42 may include a slide body received in the channel 28 and configured to slide within the channel 28 to allow for movement of the first end portion 42 relative to the base 14. Each second end portion 44 may be connected to a side face of the wheel 34 via a journal bearing that allows for pivotal or rotational movement of the support link 40 relative to the wheel 34 to facilitate transition of the support platform 12 along an elliptical path. The term support link 40, as used herein, broadly refers to the structural body or bodies that interconnect the wheel 34, the base 14 and the support platform 12. In this regard, the first end portion 42 may be integral with the second end portion 44, or alternatively, the first end portion 42 and the second end portion 44 may include separate members or bodies. Furthermore, each of the first end portion 42 and the second end portion 44 may be comprised of one or more rigid members or bodies.

The support platform 12 is connected to the support link 40 to move in concert with the support link 40. In this regard, the support link 40 may extend underneath, and along, a longitudinal centerline of the support platform 12. The support platform 12 may be connected to the support link 40 via rivets, screws, nails, adhesives, or other mechanical fasteners known in the art.

The exercise device 10 may also include a handle 46 coupled to the base 14. The handle 46 may be movable relative to the base 14, with the motion of the handle 46 being correlated to the motion of the support platform 12. For instance, as the support platform 12 moves in a forward direction, the handle 46 may also move in a forward direction, and as the support platform 12 moves in a rearward direction, the handle 46 may also move in a reward direction. According to one embodiment, the handle 46 may be coupled to the support link 40 via a lower pivot link 48 and an upper pivot link 50. The lower pivot link 48 may be pivotally coupled to support link 40 at an attachment point, which may be at an intermediate portion of the support link 40, e.g., between the first end portion 42 and the second end portion 44. In the exemplary embodiment, the lower pivot link 48 is attached to the support link 40 at a location under the support platform 12. The opposite end of the lower pivot link 48 is pivotally attached to the upper pivot link 50, which extends upwardly and attaches to the handle 46. Due to the mechanical interlinking connection of the handle 46 to the support link 40, which supports the support platform 12, movement of the support platform 12 may be correlated to movement of the handle 46.

In embodiments where the wheel 34 is in the front and the channel 28 is in the rear, the lower pivot link 48 may be connected to the second end portion 48, as shown in FIG. 5. In this regard, it may be desirable to connect the handle 46 to the support link that extends between the support platform 12 and the channel 28, rather than the support link that extends between the support platform 12 and the wheel 34.

In an alternative embodiment, or in addition to the movable handle 46, the exercise device 10 may include a handle 46 that is fixed or immovable relative to the base 14.

Although the exemplary embodiment shows only one handle 46, alternative embodiments may include a pair of handles that are moveable relative to the base 14. For instance, the other handle may also be coupled to the upper pivot link 50 via an extension rod coupled to the upper pivot link 50. Additional handles or rails may also be incorporated into the device 10 to provide further support to the user. In particular, FIGS. 1-5 show a pair of opposed horizontal rails positioned so as to extend on opposite sides of a user. The rails may be fixed/immovable, and thus, may not move in concert with the platform 12. The rails extend rearwardly from the pedestal 30 or other forwardly located structure. It is also contemplated that the device 10 may include one or more vertical rails, either in addition to, or as an alternative to, the horizontal rails. The vertical rails may extend from the base 14 and may be a more preferable support option for advanced users, who may remove the horizontal rails to allow for a greater degree of leaning in a side-to-side motion.

Figure 2:
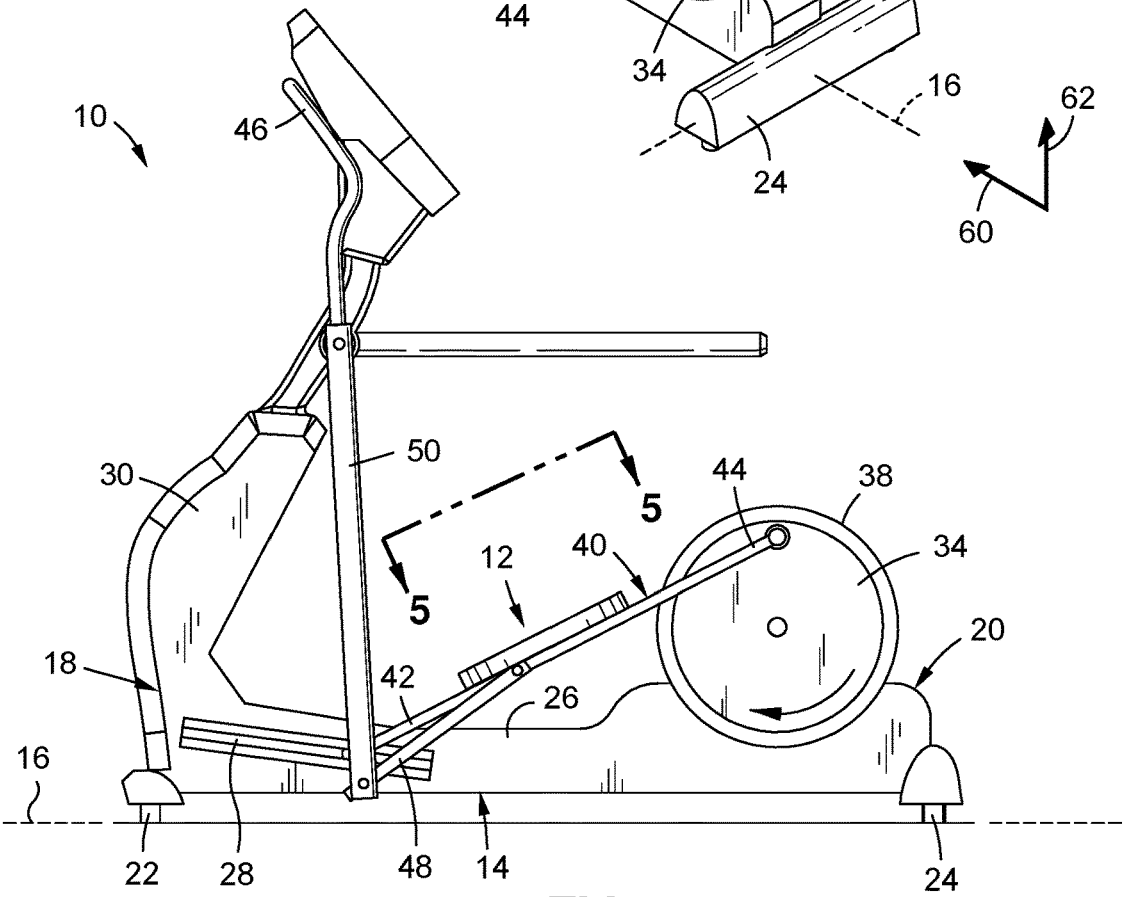
FIG. 2 is a side view of an exercise device, with the board being in a first position.
Figure 3:
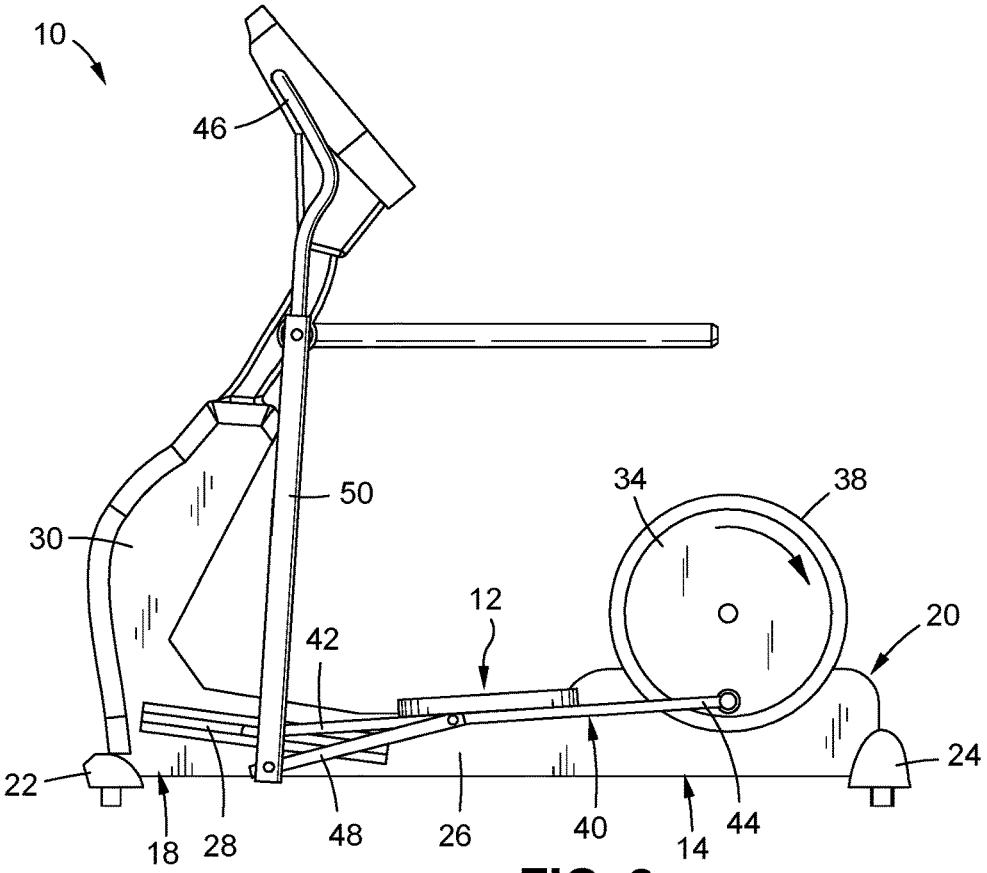
FIGS. 3 and 4 side views of the exercise device sequencing through various stages of the elliptical motion of the single board.
Figure 4:
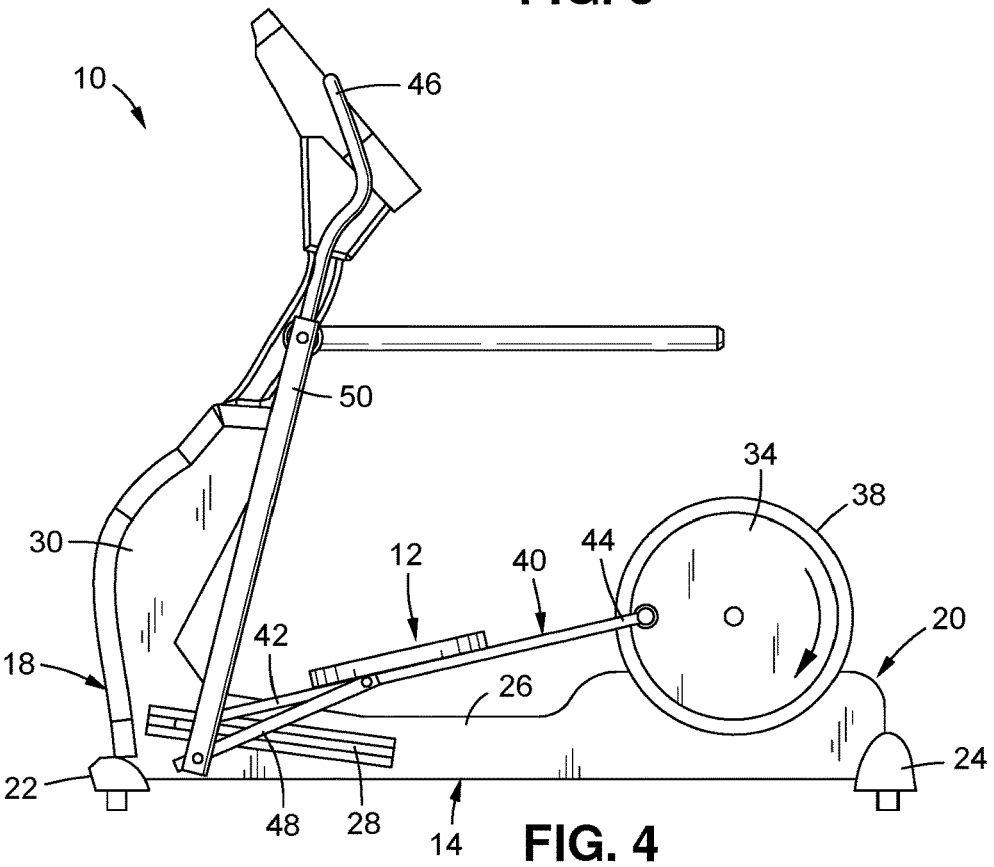

Prior to use, the user may position the support platform 12 such that connection point of the support link 40 to the wheel 34 is just beyond a center vertical axis (i.e., just passed the position shown in FIG. 2). In this regard, positioning the support platform 12 is this position may take advantage of gravity to initiate movement of the device 10. The user may stand on the support platform 12, with both of the user's feet on the support platform 12. Movement of the user on the exercise device 10 may come from using momentum of the user's body to press down on the single platform 12, preferably toward the back of the platform 12 to cause the connection point of the support link 40 to the wheel 34 to rotate in a clockwise direction. Once the support platform 12 passes the position shown in FIG. 3, the user may shift their weight forward to urge the connection point to continue its clockwise motion, while also urging the forward end portion of the support link 40 to move up the channel 28. The support platform 12 may continue toward the position shown in FIG. 4, until it returns to the position shown in FIG. 2. The cycle may be continuously repeated for the duration of the workout. The physical action of the user to propel the support platform 12 through the elliptical motion may be similar to the pumping action associated with riding a surfboard.

Figure 6:
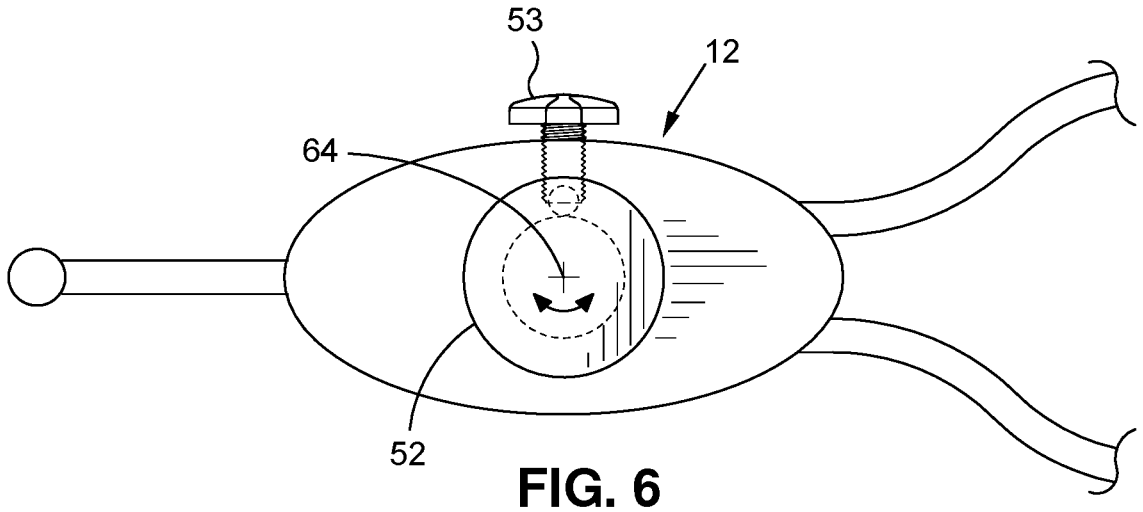
FIG. 6 is a top view of the single board coupled to a support rod, and a single rotation platform on top of the single board.

It is contemplated that various embodiments of the exercise device 10 may include one or more rotating platforms coupled to the support platform 12. Referring first to FIG. 6, there is depicted an embodiment with a first rotation platform 52 coupled to the support platform 12 and configured to rotate relative to the support platform 12 about a first rotation axis generally perpendicular to the upper surface of the support platform 12. The first rotation platform 52 may be sized to support both of the user's feet at the same time. During use, the user may stand on the first rotation platform 52 and transition through the elliptical motion described above, with the first rotation platform 52 pivoting or rotating relative to the support platform 12 about the first rotation axis. The movement of the first rotation platform 52 relative to the support platform 12 may mitigate stress on joints and/or provide an additional range of motion to further engage the user's muscles.

The exercise device 10 may additionally include a resistance adjustment member 53 operatively coupled to the first rotation platform 52 to facilitate selective adjustment of a rotational resistance of the first rotation member 52 relative to the support platform 12. For instance, the resistance adjustment member 53 may include a tensioner, screw or other rotationally actuated member that can increase or decrease pressure applied to a rotational joint between the first rotation platform 52 and the support platform 12. Of course, other resistance adjustment members known in the art may also be used without departing from the spirit and scope of the present disclosure.

The exercise device 10 may further comprise a second rotation platform 54 and a third rotation platform 56, in addition to the first rotation platform 52. Each rotation platform 52, 54, 56 may be configured to rotate about a respective rotation axis. Various configurations of the rotation platforms 52, 54, 56 may be incorporated into the exercise device 10 to achieve different degrees of motion. In one embodiment, the exercise device includes the first and second rotation platforms 52, 54 connected to the support platform 12 in spaced relation to each other. In this embodiment, the first and second rotation platforms 52, 54 may be generally equal in size and may be equally spaced from the center of the board to optimize balance. The user may place each foot on a respective rotation platform 52, 54, which may rotation independently.

Figure 7:
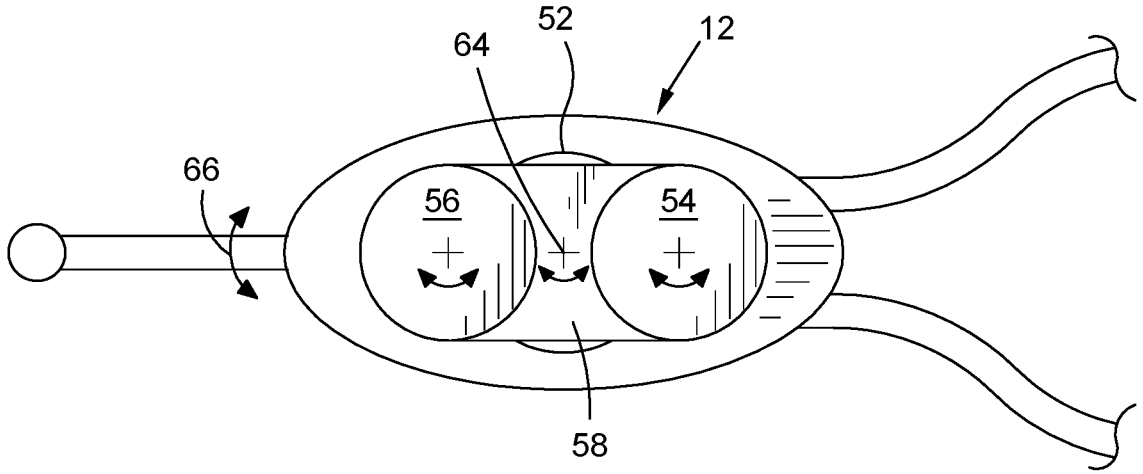
FIG. 7 is a top view of another embodiment of the single board coupled to the support rod, and a pair of rotation platforms on top of the single board.

In another embodiment, the exercise device 10 is configured such that the first rotation platform 52 resides between the single platform 12 and the second and third rotation platforms 54, 56, which may be connected via a connection platform 58. An example of this embodiment is shown in FIG. 7. In this configuration, the first rotation platform 52 may rotate relative to the support platform 12, the connection platform 58 may rotate relative to the first rotation platform 52, and the second and third rotation platforms 54, 56 may rotate relative to the connection platform 58. One of the user's feet may be placed on the second rotation platform 54, and the other foot may be placed on the third rotation platform 56.

For more information related to the structure and use of rotational platforms, please refer to U.S. Pat. No. 10,207,150, entitled Combination Therapeutic and Exercise System, the contents of which are expressly incorporated herein by reference.

As noted above, according to various embodiments of the exercise device 10, the support platform 12 can be bare, and thus include with no moving parts, e.g., no rotational platforms. Alternatively, the support platform 12 can be coupled with single or double free rotating platforms/discs, similar to conventional lazy Suzan's, in the middle of the single platform 12. Accordingly, the single support platform 12 can be: a) bare (e.g., with no additional rotational members/discs), b) integrated with a single rotating disc where both feet stand on the disc, c) integrated with double rotating discs where each foot is on separate discs, and d) integrate all three (platform, single rotating disc, and double rotating discs) on top of one another.

The rotation of the platforms/discs may be facilitated by bearings, rotation joints, or other mechanical devices known in the art that facilitate rotation, pivoting, etc. of one body relative to another body.

The support platform 12 may be moveable in up to five degrees of motion, namely, front-and-back motion (e.g., movement along axis 60, See FIG. 1), up-and-down motion (e.g., movement along axis 62, See FIG. 1), swiveling motion of the platform (e.g., swivel about an axis 64 perpendicular to the upper surface of the platform, See FIG. 7), side-to-side lean of the platform (e.g., leaning of the platform to the left and right of an underlying support bar/link, an example of which is represented by arrow 66), and 360 lean of the platform (e.g., leaning of the platform in all directions relative to an underlying support bar/link). In addition to bearings, etc. to facilitate rotation/pivoting movement, the platform 12 may also be connected to one or more hydraulic pistons to facilitate any leaning motion Contrary to the traditional elliptical exercise machine, the exercise device 10 may use only one platform 12 for supporting both of the user's feet. Furthermore, the single platform 12 may be integrated with a single or double rotating discs lazy Suzan's with optional resistance knobs, and can generate the elliptical or oblong path or other similar geometric outlines. The low-impact single platform elliptical device builds aerobic (and/or anaerobic) fitness while exercising and balancing the core of the body.

The exercise device 10 may provide smooth natural activity, while exercising a relatively large number of connected muscles through a large range of ellipses motion. Use of the exercise device 10 may also engage the brain to balance the body through the circular continuous motion by requiring coordination of the lower joints to pivot naturally (on the rotating discs) and provides for safety and stability.

The rotating discs may provide flexibility to adjust ankle and foot positions during the ellipses motion of the support platform 12. The single platform 12 sized to accommodate both feet may eliminate the need for strides, commonly associated with conventional elliptical machines, and therefore allows comfort to the users. Furthermore, the ability to integrate single or double rotating discs to the middle of the support platform 12 may provide users with a greater range of motion to their ankles and feet while providing a more complete core body movement. The integrated rotating discs may provide a total body workout resonating from the core by engaging the extremities of the body. It is contemplated that the single support board may be raised up and down to create different depths and heights for the ellipses generated by the user. Different muscle groups connected to the core of the body may work together at different levels of strenuousness allowing the mind to balance the whole body in one ellipses movement. The whole body and mind are engaged simultaneously.

In addition to the foregoing, it is contemplated that various embodiments of the exercise device 10 may be portable or may include a stationary sit-stand single platform 12 elliptical exercise machine. For example, a seat may be added to the portable embodiment or a user may use their own chair and the portable solution can be put in front of them or under a desk. The angle of the single support platform 12 can be adjusted to meet the user's preferred angle. Furthermore, the resistance can also be adjusted with a nob or similar modality to meet the users desired resistance level. Both the portable and stationary versions can be foldable for easy, safe and quick storage.

It is further contemplated that various embodiments of the exercise apparatus may include a pulley system attached for added upper body exercises. For instance, one or more cables may be routed through the pulley system to allow for back exercises, bicep exercises, tricep exercises, shoulder exercises, chest exercises, abdominal exercises, etc.

The exercise device 10 may also be configured to be wirelessly connectable to electronic monitoring devices to gage different analytical metrics (data) such as calories burned, time, pulse, heart rate, etc. In this respect, the exercise device 10 may include a wireless transmitter/receiver (e.g., transceiver), a processor, a vibration assembly, sensors, and/or electrical generators to facilitate communication, monitoring, and processing of biometric data and providing alerts to a user when one or more prescribed biometric thresholds are met. These sensors, which may be electronic, photonic, and/or magnetic may sense rotation, receive data, calculate distance, calculate calories burned, calculate energy produced, transmit calculated data to central system, device or social network, store data, and present current and past data to user on request. The sensors may allow for acquisition and monitoring of the user's metabolism, flood flow and vital signs. For more information related to the sensors, please refer to U.S. Pat. No. 10,207,150, entitled Combination Therapeutic and Exercise System, the contents of which are expressly incorporated herein by reference. Radio, camera, light, charging components and displays may also be included.

Although the foregoing describes the exercise device 10 as including a single support platform 12, it is contemplated that in other embodiments, the single support platform 12 may be divided into a pair of support platforms coupled to a single support link 40. In this regard, there may be no relative movement between the pair of support platforms during use of the exercise device 10. Such an embodiment would differ from a conventional elliptical, where a pair of support platforms move in opposite directions to each other, and are positioned on opposite sides of a centerline to allow a user to face forward during use. In the embodiment of the exercise device 10 having a pair of support platforms, the user may stand sideways, with each foot on its own support platform.

The particulars shown herein are by way of example only for purposes of illustrative discussion, and are not presented in the cause of providing what is believed to be most useful and readily understood description of the principles and conceptual aspects of the various embodiments of the present disclosure. In this regard, no attempt is made to show any more detail than is necessary for a fundamental understanding of the different features of the various embodiments, the description taken with the drawings making apparent to those skilled in the art how these may be implemented in practice.

What is claimed is:

1. An exercise device comprising:

a base configured to be positionable on an underlying surface, the base having a channel formed therein, the channel being angled relative to a plane parallel to the underlying surface;

a wheel rotatably connected to the base;

a support link having a first end portion slidably connected to the channel and a pair of second end portions each pivotally connected to the wheel on opposing sides of the wheel via a journal bearing such that the pair of second end portions move in-phase with one another as the wheel rotates;

a single platform having an upper surface sized to support both feet of a user, the single platform being connected to the support link such that the single platform moves in concert with the support link;

a first rotation member coupled to the single platform and configured to rotate relative to the single platform about a first rotation axis generally perpendicular to the upper surface; and a handle coupled to the support link via a lower pivot link and an upper pivot link, the lower pivot link defining a first end portion and a second end portion, the upper pivot link defining a first end portion and a second end portion, the first end portion of the lower pivot link being pivotally coupled to the support link about a first pivot axis, the second end portion of the lower pivot link being pivotally coupled to the first end portion of the upper pivot link about a second pivot axis, the second end portion of the upper pivot link being coupled to the handle, the second end portion of the upper pivot link being pivotable about a third pivot axis, the handle being restricted from pivotal movement relative to the upper support link wherein the lower pivot link is configured such that at least a portion thereof is moveable along an arcuate path relative to the channel.

2. The exercise device recited in claim 1, further comprising a second rotation member coupled to the single platform and configured to rotate relative to the single platform about a second rotation axis generally perpendicular to the upper surface of the single platform and spaced from the first rotation axis.

3. The exercise device recited in claim 2, further comprising a third rotation member coupled to the single platform and configured to rotate relative to the single platform about a third rotation axis generally perpendicular to the upper surface of the single platform and spaced from the first rotation axis.

4. The exercise device recited in claim 3, wherein the first rotation member resides between the single platform and the second and third rotation members.

5. The exercise device of claim 1, wherein the first pivot axis is movable relative to the base and immovable relative to the support link.

6. The exercise device of claim 5, wherein the third pivot axis is immovable relative to the base.

7. The exercise device recited in claim 1, further comprising a resistance adjustment member operatively coupled to the first rotation member to facilitate selective adjustment of a rotational resistance of the first rotation member relative to the single platform.

8. The exercise device recited in claim 1, wherein the handle is movable relative to the base.

9. The exercise device of claim 1, wherein the base includes a cover extending over the outer diameter of the wheel.

10. A low-impact, reciprocating exercise device comprising:

a base configured to be positionable on an underlying surface, the base extending along a longitudinal axis between a forward end portion and a rearward end portion, the base having a channel formed therein, the channel being angled relative to a plane parallel to the underlying surface;

a support link having a first end portion slidably connected to the channel;

a support platform operatively coupled to the base and moveable relative to the base along an elliptical path in a direction generally parallel to the longitudinal axis, the support platform being sized and configured to simultaneously support both feet of a user, the support platform being connected to the support link such that the support platform moves in concert with the support link;

a first rotational platform coupled to the support platform and configured to rotate relative to the support platform about a first rotational axis perpendicular to the support platform;

a handle operatively coupled to the support platform via a lower pivot link and an upper pivot link, the lower pivot link defining a first end portion and a second end portion, the upper pivot link defining a first end portion and a second end portion, the first end portion of the lower pivot link being pivotally coupled to the support link about a first pivot axis, the second end portion of the lower pivot link being pivotally coupled to the first end portion of the upper pivot link about a second pivot axis, the second end portion of the upper pivot link being coupled to the handle, the second end portion of the upper pivot link being pivotable about a third pivot axis;

wherein at least a portion of the lower pivot link is moveable along an arcuate path relative to the channel; and a second rotation platform coupled to the support platform and configured to rotate relative to the support platform about a second rotation axis generally perpendicular to an upper surface of the support platform and spaced from the first rotational axis.

11. The exercise device recited in claim 10, further comprising a third rotation platform coupled to the support platform and configured to rotate relative to the support platform about a third rotation axis generally perpendicular to the upper surface of the support platform and spaced from the first rotational axis.

12. The exercise device recited in claim 11, wherein the first rotational platform resides between the support platform and the second and third rotation platforms.

13. The exercise device recited in claim 10, further comprising a resistance adjustment member operatively coupled to the first rotational platform to facilitate selective adjustment of a rotational resistance of the first rotational platform relative to the support platform.

14. The exercise device recited in claim 10, wherein the handle is movable relative to the base.

15. The exercise device of claim 10, wherein the first end portion of the support link has a slide body received in the channel, the slide body being configured to slide within the channel to allow the first end portion of the support link to be movable relative to the base.

16. An exercise device comprising:

a base;

a wheel connected to the base;

a support link having a first end portion slidably connected to the base and a pair of second end portions each pivotally connected to the wheel on opposing sides of the wheel such that the pair of second end portions move in-phase with one another as the wheel rotates;

a single platform having an upper surface sized to support both feet of a user and a lower surface opposite the upper surface, the single platform being connected to the support link such that the single platform moves in concert with the support link;

a lower pivot link operatively coupled to the support link at an attachment point between the first end portion and the second end portion of the support link; and an upper pivot link defining an upper end portion and a lower end portion, the lower end portion of the upper pivot link operatively coupled to the lower pivot link, and the upper end portion of the upper pivot link operatively coupled to a handle to allow for movement of the handle to correlate to movement of the single platform.

17. The exercise device of claim 16, wherein the attachment point is adjacent the lower surface of the single platform.

18. The exercise device of claim 16, further comprising a first rotation member coupled to the single platform and configured to rotate relative to the single platform about a first rotation axis generally perpendicular to the upper surface.

19. The exercise device of claim 16, wherein the pair of second end portions are pivotally connected on opposing sides of the wheel by a journal bearing.

* * * * *